US008002576B1

(12) United States Patent
Cheng et al.

(10) Patent No.: US 8,002,576 B1
(45) Date of Patent: Aug. 23, 2011

(54) MODULAR JACK INCORPORATED WITH LED COMPARTMENT

(75) Inventors: Sen Cheng, Kunshan (CN); Li-Zhi Zhang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/906,148

(22) Filed: Oct. 18, 2010

(30) Foreign Application Priority Data

Sep. 1, 2010 (CN) ..... 2010 2 0513026

(51) Int. Cl.
*H01R 3/00* (2006.01)

(52) U.S. Cl. ..... 439/488

(58) Field of Classification Search ..... 439/488, 439/541.5, 188, 676, 688, 944, 607.01, 489
See application file for complete search history.

(56) References Cited

U.S. PATENT DOCUMENTS

| | | | | |
|---|---|---|---|---|
| 6,835,092 | B2 * | 12/2004 | Wan et al. | 439/541.5 |
| 7,241,157 | B2 * | 7/2007 | Zhuang et al. | 439/188 |
| 7,563,116 | B2 * | 7/2009 | Wang | 439/188 |
| 7,575,454 | B1 * | 8/2009 | Aoki et al. | 439/188 |

FOREIGN PATENT DOCUMENTS

TW M347729 12/2008

* cited by examiner

*Primary Examiner* — Jean F Duverne
(74) *Attorney, Agent, or Firm* — Andrew C. Cheng; Wei Te Chung; Ming Chieh Chang

(57) ABSTRACT

An electrical connector (100) includes an insulative housing (1) with a mating space (13), a plurality of contacts (21) disposed in the insulative housing (1) with a mating portion (211) protruding into the mating space (13), a metallic shell (4) covering the insulative housing and a pair of LEDs (3) disposed at a corner of the insulative housing (1) and capable of emitting light indicating proper function thereof. Each LED (3) includes a pair of contact legs (31, 32), one of the contact legs (32) has a crank-shaped portion (320) sandwiched between a pair of protruding tubers (125*a*, 125*b*) formed by the insulative housing (1).

10 Claims, 5 Drawing Sheets

MODULAR JACK INCORPORATED WITH LED COMPARTMENT

1. FIELD OF THE INVENTION

The present invention relates to a modular jack, and more particularly, to a modular jack incorporated with a compartment in which an LED can be properly positioned therein without inadvertently damaged.

2. DESCRIPTION OF THE RELATED ART

TW Pat. Utility No. M347729 issued to Cheng on Dec. 21, 2008, discloses an electrical connector standing on a PCB for communicating network signal. The electrical connector includes an insulative housing, a plurality of contacts received in the housing, a metal shell covering the insulative housing and a pair of LED devices incorporated in both sides of the insulative housing for showing a connecting status of the electrical connector. The insulative housing has a mating space with a frontward opening for receiving a plug jack along a mating direction and a plurality of receiving grooves extending through the mating recess for receiving the contacts therein. The insulative housing defines a pair of through-holes extending along the mating direction in which the LED devices are inserted into said through-holes and locked by an insulative latch integrally formed by the insulative housing. Each of the LED devices includes a pair of LED contacts and a light body retaining the LED contacts together. The light body of the LED device is retained in the through-hole. The LED contacts extend towards the outside of the insulative housing.

However, the light body of the LED device is needed to form a step portion and blocking with the insulative latch. So the structure of electrical connector is comparably complicate. Moreover, the insulative latch of the insulative housing could be easily broken when the LED device is assembled into the insulative housing, even involves the LED device.

Therefore, an improved electrical connector is desired to overcome the disadvantages of the related arts.

SUMMARY OF THE INVENTION

An object of the present invention is to provide an electrical connector capable of overcoming disadvantage of the prior art in which LED is held by a comparably complex positioning structure and fails to meet miniaturization requirement.

In order to achieve the above-mentioned object, an electrical connector in accordance with a preferred embodiment of the present invention includes an insulative housing with a mating space, a plurality of contacts disposed in the insulative housing with a mating portion protruding into the mating space, a metallic shell covering the insulative housing and a pair of LEDs disposed at a corner of the insulative housing and capable of emitting light indicating proper function thereof. Each LED includes a pair of contact legs, one of the contact legs has a crank-shaped portion sandwiched between a pair of protruding tubers formed by the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
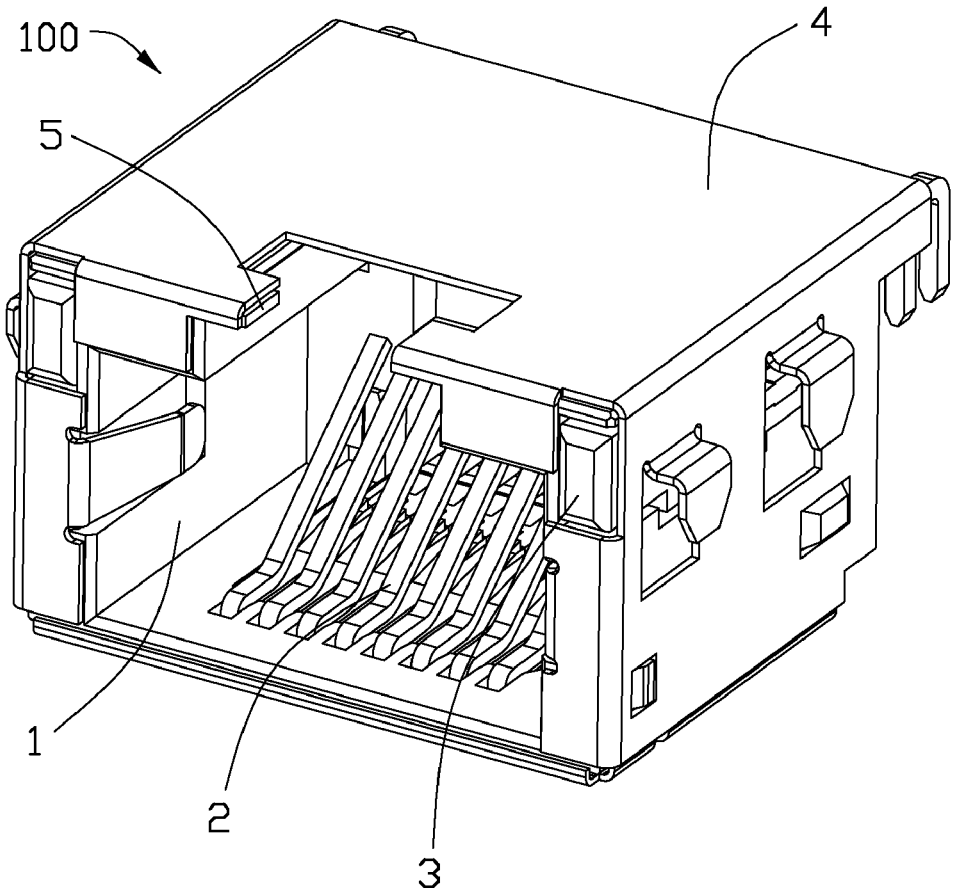
FIG. 1 is a perspective view of an electrical connector in accordance with the preferred embodiment of the present invention.

Reference will now be made to the drawing figures to describe the preferred embodiment of the present invention in detail.

Referring to FIG. 1, an electrical connector 100 which can electrically interconnect with a mating plug for transmitting a network or communication signal is shown. The electrical connector 100 includes an insulative housing 1, a contact module 2 assembled into the insulative housing 1, a pair of LED 3 disposed in the insulative housing 1 and a metallic shell 4 substantially enclosing outer surface of the insulative housing 1 for providing a shielding to the electrical connector 100.

Figure 2:
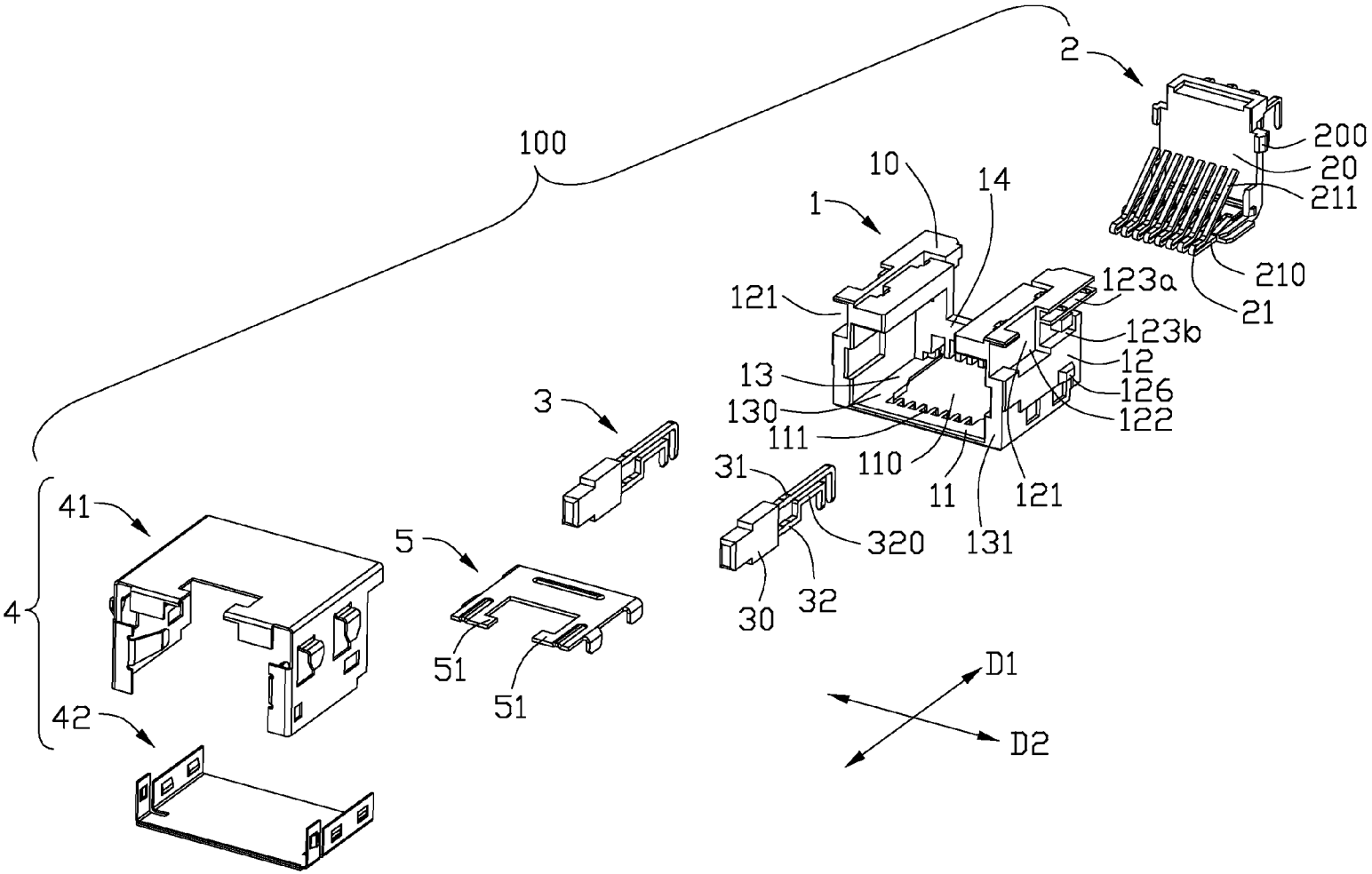
FIG. 2 is an exploded perspective view of FIG. 1.
Figure 3:
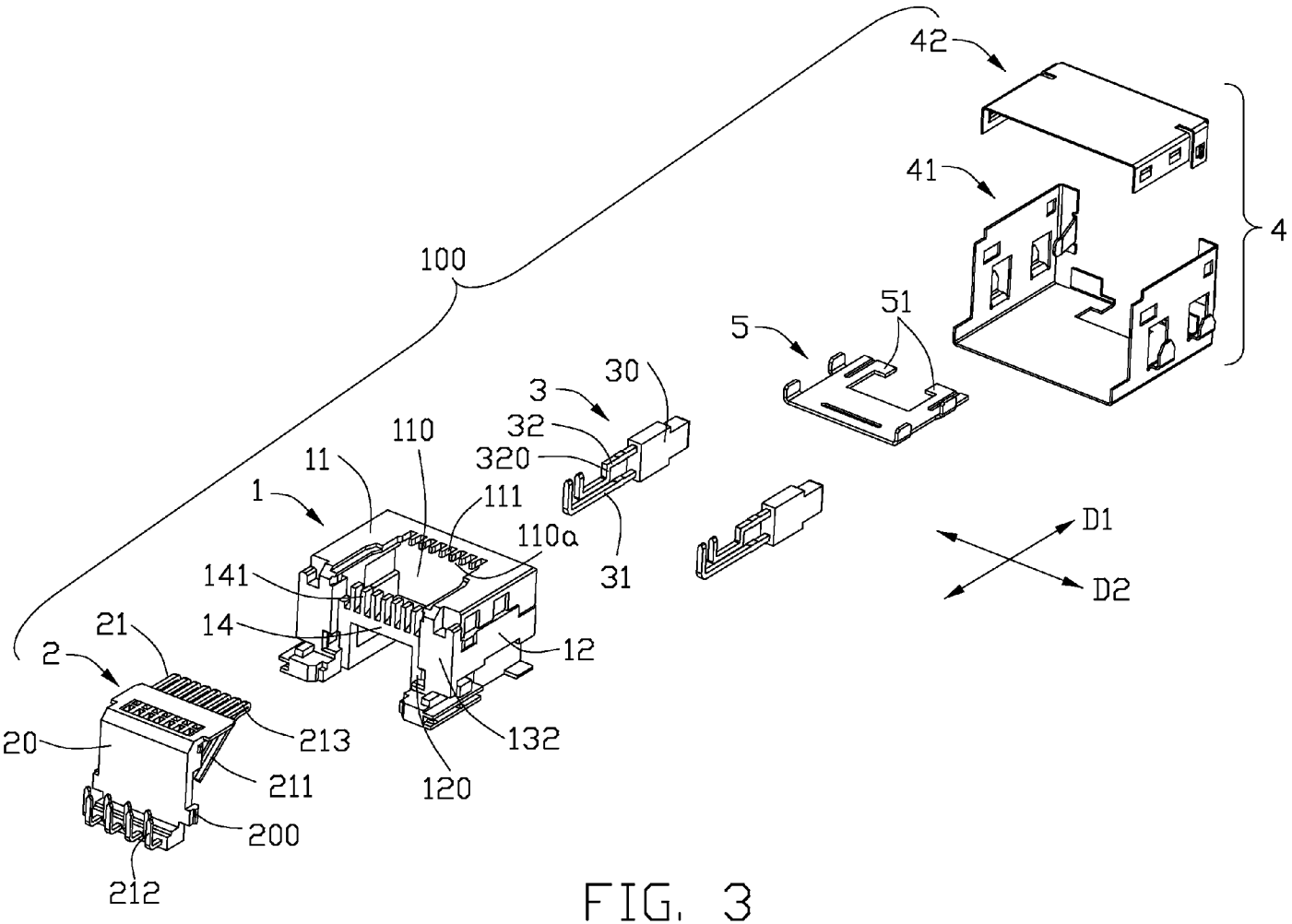
FIG. 3 is another exploded perspective view of FIG. 1 from a rear side view.

Referring to FIGS. 2 and 3, the insulative housing 1 includes a top wall 10, a bottom wall 11, and a pair of side walls 12 unitarily connecting with the top wall 10 and the bottom wall 11, thereby forming a mating space 13 with a frontward mating opening 130 for receiving the mating plug inserted thereinto. The mating space 13 extends through a front surface 131 and a rear surface 132 of the insulative housing 1 along a mating direction (or a front-to-rear direction) marked as D1 and extends through of the top wall 10 for easily and readily receiving the mating plug. The bottom wall 11 defines a receiving mouth 110 in extending through thereof and in communicating with the mating space 13 for receiving the contact module 2 therein. The contact module 2 is assembled into the receiving mouth 110 from the rear surface 132 of the insulative housing 1. The contact module 2 includes an insulative body 20 retained in the insulative housing 1 together and a plurality of contacts 21 embedded in the insulative body 20 and having a mating portion 211 extending into the mating space 13 for electrically connecting with the mating plug. The insulative body 20 defines a blocking portion 200 retained in a blocking recess 120 formed by the side wall 12 for preventing the contact module 2 from moving inadvertently.

Each of the contacts 21 has a connecting portion 210 connecting the insulative body 20 with the mating portion 211 and a terminal portion 212 extending outwards for soldering with a PCB (not shown). The mating portion 211 extends from the connecting portion 210 and turning back towards the insulative body 20, i.e. the mating portion 211 forms an approximately V-shaped configuration with the connecting portion 210. The insulative housing 1 defines a connecting beam portion 14 integrally connecting between the two side walls 12 and forming a plurality of partitioning walls 141 for correspondingly separating the mating portions 211 of the contacts 21 with each other. The bottom wall 11 defines a plurality of receiving grooves 111 disposed at front edge 110*a* of the receiving mouth 110 and retaining a front edge 213 of the contacts 21 therein for preventing the contacts 21 from moving forwards.

Figure 4:
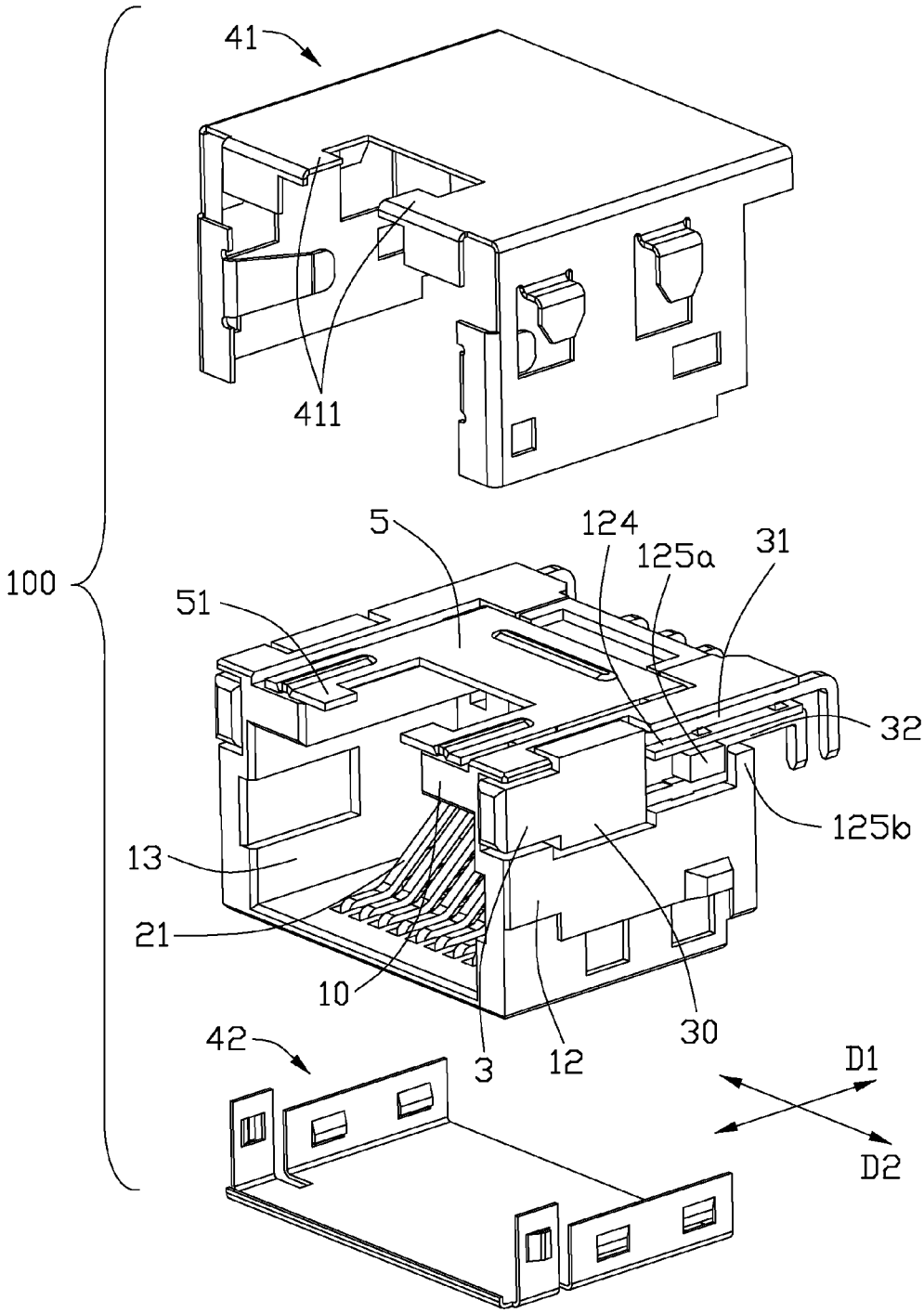
FIG. 4 is a partly perspective view of FIG. 1.
Figure 5:
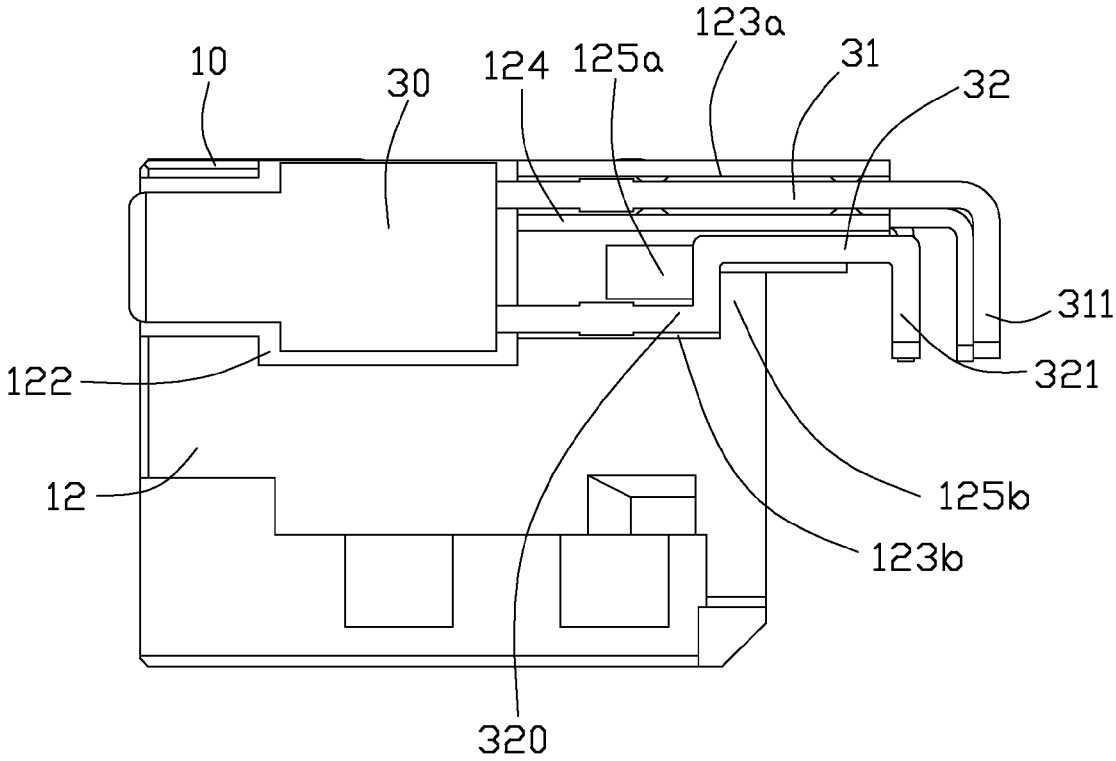
FIG. 5 is a side view of the electrical connector without a metallic shielding of FIG. 4.

Referring to FIGS. 2, 4 and 5, each of the LEDs 3 is disposed at a corner of the top wall 10 and the side wall 12 and capable of emitting light indicating proper function thereof. The LED 3 includes a light body 30 capable of emitting light, a first contact leg 31 and a second contact leg 32 both retained in the light body 30 and extending outwards from the light body 30. Correspondingly, the insulative housing 1 has a receiving section 121 for receiving the LEDs 3 therein. The receiving section 121 extends through the front surface 131 for making the light body 30 being seen by user conveniently. The LEDs 3 are assembled in the receiving sections 121 along a transverse direction marked as D2 and which is perpendicular to the mating direction D1, i.e. LED 3 will not overly interfere with the insulative housing 1 during assembling process. So the height of the electrical connector is decreased and merely be broke.

The receiving section 121 includes a receiving recess 122 for receiving the light body 30, a first slot 123*a* and a second slot 123*b* which are both extending from the receiving recess 122 and separate from each other by a protruding portion 124. The first contact leg 31 is an laid-down L-shaped configuration, received in the first slot 123*a* and includes a soldering portion 311 extending outwards for soldering with the PCB. The second contact leg 32 is received in second slot 123*b* and sandwiched between a pair of protruding tubers 125*a*, 125*b* opposite to each other. The second contact leg 32 defines a crank-shaped portion 320 in engaging with the two protruding tubers 125*a*, 125*b* for preventing the second contact leg 32 from moving rearwards and forwards. In such a manner that the LEDs 3 is held by a simple positioning structure and merely be broken during assembling process. The second contact leg 32 also includes a soldering portion 321 extending downwards from crank-shaped portion 320 continually.

Referring to FIGS. 2 to 4, the metallic shell 4 includes a top shell 41 and a bottom shell 42 interlocked with each other. The top shell 41 defines a through hole 410 engaging with a tuber 126 formed by the insulative housing 1. The bottom shell 42 includes a pair of blocking portion. The electrical connector 100 includes a metallic bracket 5 retained in the top wall 10 and engaging with the top shell 41. The metallic bracket 5 has a pair of locking portions 51 protruding into the mating space 13 for locking with the mating plug steadily. The top shell 41 defines a pair of protecting portions 411 pressing upon the locking portions 51 for preventing the locking portions 51 from deformation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing defining a mating space;

a plurality of contacts disposed in the insulative housing, each comprising a mating portion protruding into the mating space;

a pair of LEDs disposed at a corner of the insulative housing and capable of emitting light indicating proper function thereof;

a metallic shell substantially enclosing outer surface of the insulative housing; and wherein the LED comprises a pair of contact legs, one of the contact legs comprising a crank-shaped portion sandwiched between a pair of protruding tubers formed by the insulative housing; wherein the insulative housing comprises a pair of side walls surrounding the mating space and the LED is assembled into the insulative housing in a transverse direction perpendicular to the side wall; wherein the contact legs comprises a first contact leg and a second contact leg with the crank-shaped portion, which are separated from each other by a protruding portion of the insulative housing; wherein the LED comprises a light body received in the insulative housing and retained the first contact leg and the second contact leg together; wherein the first contact leg is a laid-down L-shaped configuration and comprises a soldering portion extending outwards from the light body; wherein the side walls comprises a receiving recess for receiving the light body, a first slot receiving the first contact leg and a second slot for receiving the second contact leg, which are both extended from the receiving recess and separate from each other by the protruding portion.

2. The electrical connector as described in claim 1, wherein the insulative housing comprises a crank-shaped slot for receiving the second contact leg correspondingly.

3. The electrical connector as described in claim 1, wherein the mating space comprises a frontward mating opening for receiving a mating plug inserted into along a mating direction perpendicular to the transverse direction.

4. The electrical connector as described in claim 3, further comprising a metallic bracket defining a pair of locking portions protruding into the mating space.

5. The electrical connector as described in claim 4, wherein the shell comprises a pair of protecting portions pressing against the locking portions.

6. An interconnecting system, comprising:

an insulative housing defining a top wall, a bottom wall and a pair of side walls, thereby forming a mating space with a frontward opening;

a plurality of contacts disposed in the insulative housing;

a pair of LEDs disposed in the insulative housing and capable of emitting light indicating proper function thereof;

a metallic shell substantially enclosing outer surface of the insulative housing; and wherein the LED comprises a pair of contact legs, one of the contact legs is retained in a first slot and held by the insulative housing in a vertical direction perpendicular to the bottom wall and the other contact legs is retained by the insulative housing in a front-to-rear direction perpendicular to the vertical direction; wherein the LED is assembled into the side wall in a transverse direction which is perpendicular to the side wall and the front-to-rear direction; wherein the contact legs comprises a first contact leg with a laid-down L-shaped portion and a second contact leg with the crank-shaped portion, which are separated from each other by a protruding portion of the insulative housing; wherein the crank-shaped portion of the second contact leg is sandwiched between a pair of protruding tubers formed by the insulative housing.

7. An electrical connector comprising:

an insulative housing defining a mating cavity dimensioned for receiving a modular plug and extending in a front-to-back direction and forwardly communicating with an exterior, said mating cavity including a main space and a latch space located beside said main space in a vertical direction perpendicular to said front-to-back direction, and a pair of receiving recesses spaced from and located by two sides of said mating cavity in forward communication with the exterior and essentially located at a same level with the latch space in a transverse direction perpendicular to both said front-to-back direction and said vertical direction;

a plurality of contacts disposed in the housing with contacting sections exposed into the main space of the mating cavity; and a pair of LED (Laser Emitting Diode) devices respectively received in the corresponding receiving recesses; wherein said LED device includes a front light body with a larger cross-section thereof, and rear contact legs having smaller cross-sections thereof; wherein each of said recesses is open sideward in the transverse direction and rearward in said front-to-back direction the LED device and the receiving recess are configured with corresponding protruding structures only allowing the LED device to be assembled into the corresponding recess in the transverse direction.

8. The electrical connector as claimed in claim 7, wherein said protruding structures confine both said light body and said contact legs in said front-to-back direction.

9. The electrical connector as claimed in claim 7, wherein tails of the contact legs of the LED devices and tails of the contacts are located essentially at said same level.

10. The electrical connector as claimed in claim 7, wherein said light body received in the corresponding recess, is rectangular with said cross-section taken along a thickness direction which is same with the transverse direction.

* * * * *